US012716369B2

(12) United States Patent
Sato et al.

(10) Patent No.: US 12,716,369 B2
(45) Date of Patent: Aug. 25, 2026

(54) TURBINE HOUSING, TURBINE, AND TURBOCHARGER

(71) Applicant: MITSUBISHI HEAVY INDUSTRIES ENGINE & TURBOCHARGER, LTD., Sagamihara (JP)

(72) Inventors: Katsuya Sato, Tokyo (JP); Daiki Kitagawa, Tokyo (JP); Shoeji Nakaye, Tokyo (JP); Yukihide Nagayo, Tokyo (JP); Nobuhito Oka, Sagamihara (JP); Youji Akiyama, Sagamihara (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 18/996,849

(22) PCT Filed: Dec. 2, 2022

(86) PCT No.: PCT/JP2022/044609

§ 371 (c)(1),
(2) Date: Jan. 17, 2025

(87) PCT Pub. No.: WO2024/116411

PCT Pub. Date: Jun. 6, 2024

(65) Prior Publication Data

US 2026/0028920 A1 Jan. 29, 2026

(51) Int. Cl.
*F01D 25/24* (2006.01)
*F01D 9/02* (2006.01)

(52) U.S. Cl.
CPC ..... *F01D 25/24* (2013.01)

(58) Field of Classification Search
CPC ..... F01D 9/026; F01D 25/24; F01D 1/023; F01D 25/30; F05D 2220/40;
(Continued)

(56) References Cited

U.S. PATENT DOCUMENTS 9,874,222 B2 * 1/2018 Yoshida ..... F04D 29/403
10,487,676 B2 * 11/2019 Hughes ..... F01D 25/24
(Continued)

FOREIGN PATENT DOCUMENTS

JP 63-140 U 1/1988
JP 2013-142324 A 7/2013
(Continued)

OTHER PUBLICATIONS

International Preliminary Report on Patentability and Written Opinion of the International Searching Authority for International Application No. PCT/JP2022/044609, dated Jun. 12, 2025, with English translation.

(Continued)

*Primary Examiner* — Eric J Zamora Alvarez
(74) *Attorney, Agent, or Firm* — Birch, Stewart, Kolasch & Birch, LLP

(57) ABSTRACT

Turbine housing for accommodating at least a portion of a turbine wheel comprises: a first scroll flow path for supplying a working gas to the turbine wheel; and a first tongue portion that includes, in a cross section along the axial direction of the turbine wheel, inner end edges between the front edges of turbine wheel impellers and facing each other across a clearance in the radial direction of the turbine wheel. The inner end edges each include one or more inclined portions that incline relative to the axial direction. The inner end edge is configured to satisfy B≥0.2A, A being the size of the area in the axial direction where the front edge is provided, and B being the total of sizes of the areas in the axial direction where the one or more inclined portions are respectively provided.

13 Claims, 9 Drawing Sheets

(58) Field of Classification Search
CPC ..... F05D 2250/38; F05D 2250/51; F05D 2250/71; F05D 2210/12; F05D 2240/12; F05D 2240/30; F05D 2250/314; F05D 2260/96; F02B 37/025; F02B 37/00; F02B 39/00; F02C 6/12; F04D 29/403; F01N 13/107
See application file for complete search history.

(56) References Cited

U.S. PATENT DOCUMENTS

| | | | |
|---|---|---|---|
| 2014/0294577 | A1 | 10/2014 | Yoshida et al. |
| 2015/0345433 | A1 | 12/2015 | Dale et al. |
| 2017/0022830 | A1 | 1/2017 | Hughes |

FOREIGN PATENT DOCUMENTS

| | | | |
|---|---|---|---|
| JP | 2016-173068 | A | 9/2016 |
| JP | 2020-133587 | A | 8/2020 |
| JP | 2021-134719 | A | 9/2021 |
| JP | 2021-152347 | A | 9/2021 |

OTHER PUBLICATIONS

International Search Report for International Application No. PCT/JP2022/044609, dated Jan. 24, 2023, with English translation.

* cited by examiner

TURBINE HOUSING, TURBINE, AND TURBOCHARGER

TECHNICAL FIELD

The present disclosure relates to a turbine housing, a turbine, and a turbocharger.

BACKGROUND ART

PTL 1 discloses a double-scroll turbocharger in which two scroll flow paths that supply exhaust gas to a turbine wheel are formed. In addition, PTL 1 discloses a turbocharger including three scroll flow paths.

CITATION LIST

Patent Literature

[PTL 1] United States Patent Application Publication No. 2015-0345433

SUMMARY OF INVENTION

Technical Problem

However, in a turbine of the turbocharger, a vortex generated at a position of a tongue portion formed at a position of an outlet of the scroll flow path may interfere with blades of the turbine wheel to generate noise. This phenomenon occurs even in a case where the number of scroll flow paths is one, but particularly in a case where the number of scroll flow paths is two or more, rotation of the turbine fluctuates due to a difference in flow efficiency at the outlet of each scroll flow path, and the noise is likely to increase.

In view of the above circumstances, an object of at least one embodiment of the present disclosure is to provide a turbine housing capable of realizing a turbine having excellent quietness, and a turbine and a turbocharger including the turbine housing.

Solution to Problem

In order to achieve the above object, a turbine housing according to at least one embodiment of the present disclosure is a turbine housing that houses at least a part of a turbine wheel, the turbine housing including:

- a first scroll flow path for supplying a working gas to the turbine wheel; and
- a first tongue portion formed at a position of an outlet of the first scroll flow path,
- in which, in a cross section along an axial direction of the turbine wheel, the first tongue portion includes an inner end edge that faces a front edge of a blade of the turbine wheel with a clearance in a radial direction of the turbine wheel interposed between the inner end edge and the front edge,
- the inner end edge includes at least one inclined portion inclined with respect to the axial direction, and
- in a case where a size of a range where the front edge is provided in the axial direction is denoted by A, and a total of sizes of a range where each of the at least one inclined portion is provided in the axial direction is denoted by B, the inner end edge is configured to satisfy $B \geq 0.2A$.

In order to achieve the above object, a turbine according to at least one embodiment of the present disclosure includes a turbine wheel; and the above-described turbine housing.

In order to achieve the above object, a turbocharger according to at least one embodiment of the present disclosure includes the above-described turbine.

Advantageous Effects of Invention

According to at least one embodiment of the present disclosure, there are provided a turbine housing capable of realizing a turbine having excellent quietness, and a turbine and a turbocharger including the turbine housing.

DESCRIPTION OF EMBODIMENTS

Figure 1:
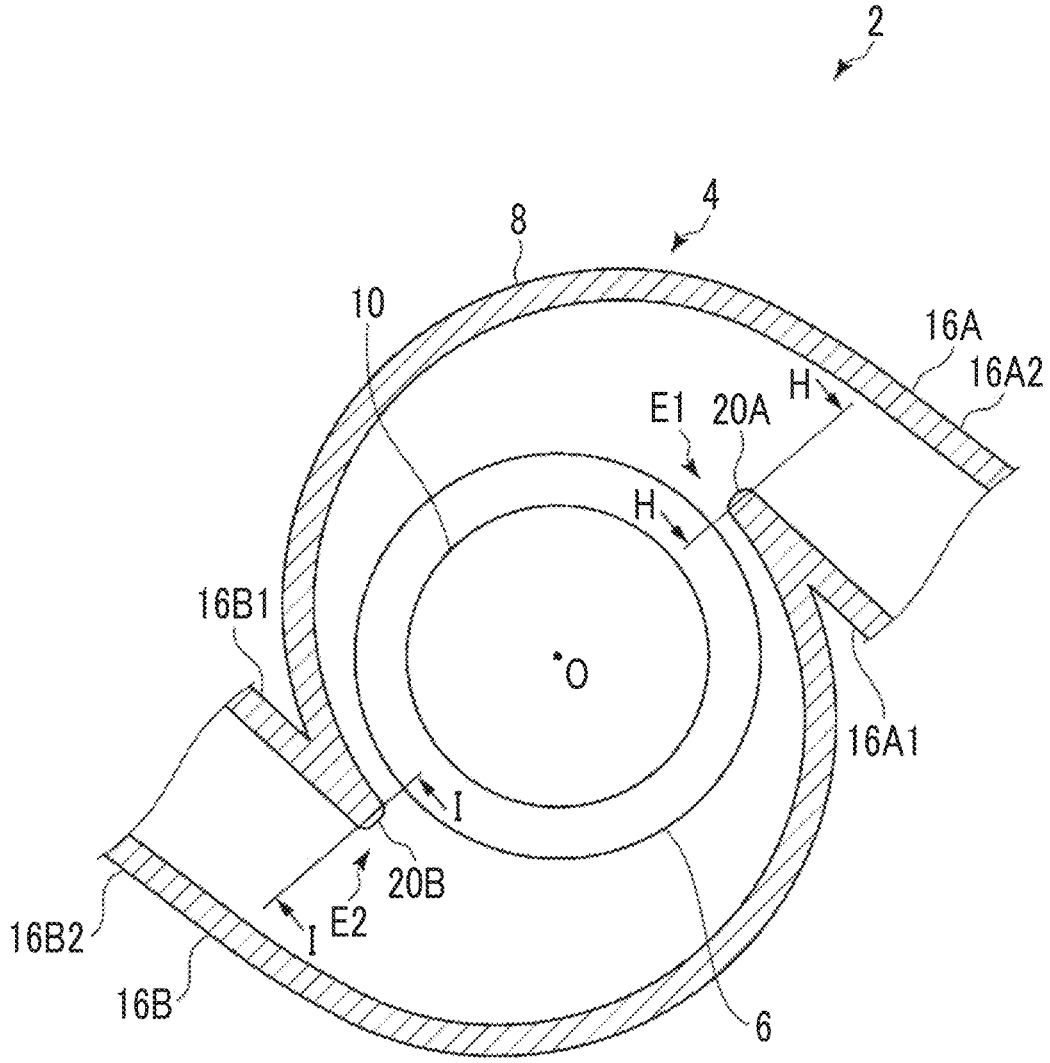
FIG. 1 is a schematic cross-sectional view schematically illustrating an example of a cross section orthogonal to an axial direction of a turbine 4 of a turbocharger 2 according to an embodiment.

Hereinafter, some embodiments of the present disclosure will be described with reference to the accompanying drawings. Dimensions, materials, shapes, relative arrangements, and the like of components described as embodiments or illustrated in the drawings are not intended to limit the scope of the invention, but are merely explanatory examples.

For example, expressions representing relative or absolute dispositions such as "in a certain direction", "along a certain direction", "parallel", "orthogonal", "center", "concentric", or "coaxial" not only strictly represent the dispositions, but also represent a state where the dispositions are relatively displaced with a tolerance or at an angle or a distance to such an extent that the same function can be obtained.

For example, expressions representing that things are in an equal state such as "same", "equal", and "homogeneous" not only strictly represent an equal state, but also represent a state where a difference exists with a tolerance or to such an extent that the same function can be obtained.

For example, expressions representing shapes such as a quadrangular shape and a cylindrical shape not only represent shapes such as a quadrangular shape and a cylindrical shape in a geometrically strict sense, but also represent shapes including an uneven portion or a chamfered portion within a range where the same effect can be obtained.

In addition, expressions of "being provided with", "being equipped with", "including", or "having" one component are not exclusive expressions excluding the presence of other components.

Figure 2:
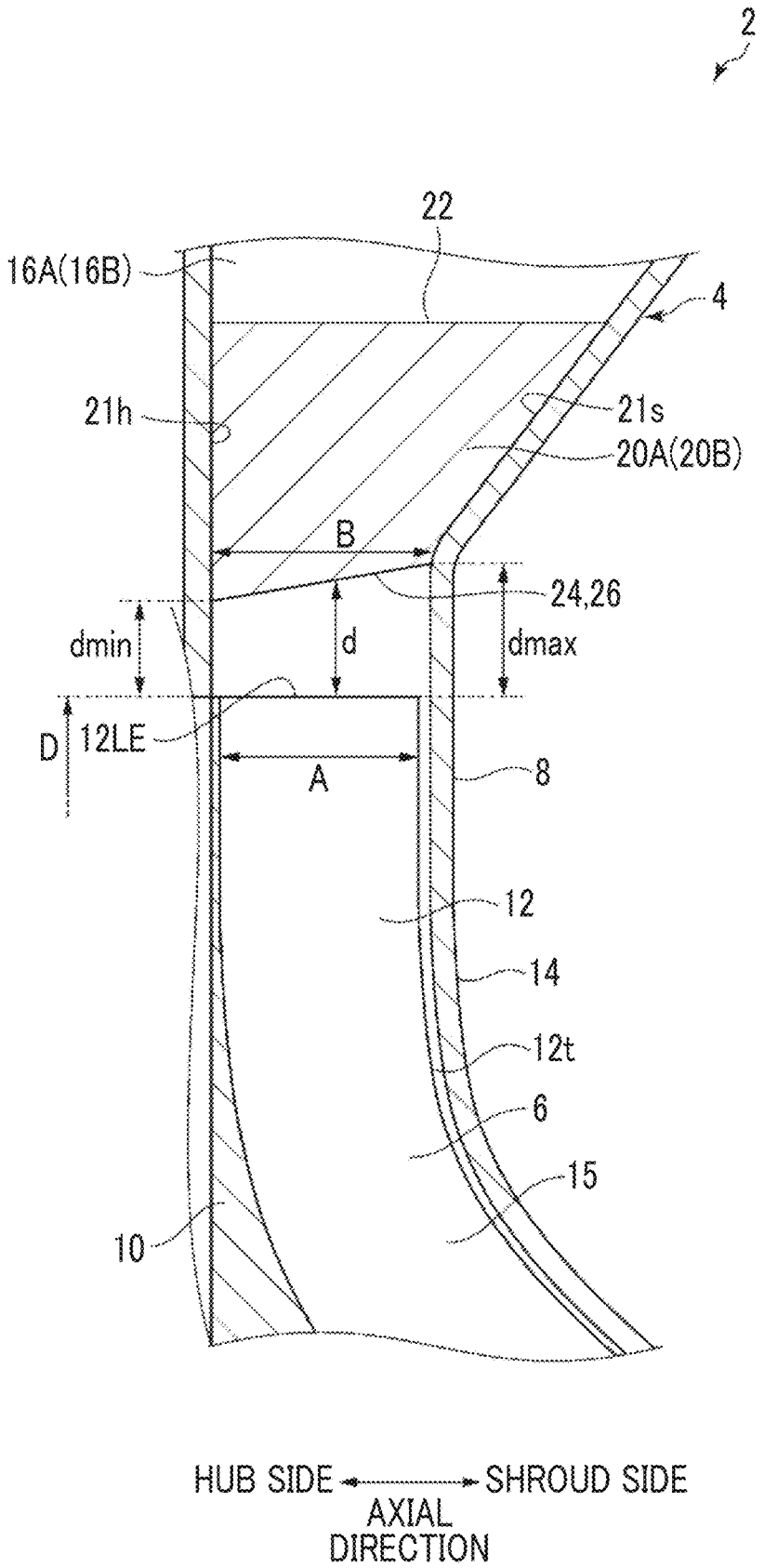
FIG. 2 is a schematic sectional view illustrating an example of an H-H cross section and an example of an I-I cross section of FIG. 1.

FIG. 1 is a schematic cross-sectional view schematically illustrating an example of a cross section orthogonal to an axial direction of a turbine 4 of a turbocharger 2 according to an embodiment. FIG. 2 is a schematic sectional view illustrating an example of an H-H cross section and an example of an I-I cross section of FIG. 1. Note that the above-described H-H cross section is a cross section (meridian plane of the turbine 4) along the axial direction in the turbine 4, and more specifically, is a cross section passing through a tongue portion 20A, which will be described below, including a rotational axis line O of a turbine wheel 6. In addition, the above-described I-I cross section is a cross section (meridian plane of the turbine 4) along the axial direction in the turbine 4, and more specifically, is a cross section passing through a tongue portion 20B, which will be described below, including the rotational axis line O of the turbine wheel 6.

Note that in the present specification, unless otherwise specified, the "axial direction" means the axial direction of the turbocharger 2, that is, the axial direction of the turbine wheel 6 of the turbine 4, the "radial direction" means the radial direction of the turbocharger 2, that is, the radial direction of the turbine wheel 6 of the turbine 4, and the "circumferential direction" means the circumferential direction of the turbocharger 2, that is, the circumferential direction of the turbine wheel 6 of the turbine 4.

The turbocharger 2 illustrated in FIGS. 1 and 2 may be, for example, a turbocharger for an automobile, and includes the turbine 4 and a compressor (not illustrated). The turbine 4 is a radial turbine including the turbine wheel 6 and a turbine housing 8 that houses the turbine wheel 6. The turbine wheel 6 is connected to an impeller of a compressor (not illustrated) through a rotary shaft (not illustrated), and is configured to integrally rotate with the turbine wheel 6 and the impeller.

The turbine housing 8 includes a shroud 14 (refer to FIG. 2), a scroll flow path 16A (refer to FIG. 1), and a scroll flow path 16B (refer to FIG. 1).

For example, as illustrated in FIG. 2, the turbine wheel 6 includes a hub 10 and a plurality of blades 12 that are provided on an outer peripheral surface of the hub 10 at intervals in the circumferential direction. The shroud 14 is disposed to face leading edges 12*t* of the plurality of blades 12 through a clearance, and forms an exhaust gas passage 15 through which exhaust gas of an engine (not illustrated) passes, with respect to the hub 10. The exhaust gas of the engine functions as a working gas for rotating the turbine wheel 6.

For example, as illustrated in FIG. 1, each of the scroll flow path 16A and the scroll flow path 16B is configured to guide the exhaust gas of the engine to the turbine wheel 6. The scroll flow path 16A and the scroll flow path 16B are connected to the exhaust gas passage 15 in different ranges in the circumferential direction on an outer peripheral side of the turbine wheel 6 (in the example illustrated in FIG. 1, ranges shifted by 180 degrees from each other in the circumferential direction), and are formed in a vortex shape around the rotational axis line O of the turbine wheel 6.

For example, as illustrated in FIG. 1, the turbine housing 8 includes the tongue portion 20A having a tongue shape (protrusion shape), which is formed by a portion where a flow path wall 16A1 on an inner side in the radial direction in the scroll flow path 16A and a flow path wall 16B2 on an outer side in the radial direction in the scroll flow path 16B are connected to each other, at a position of an outlet E of the scroll flow path 16A. In addition, the turbine housing 8 includes the tongue portion 20B having a tongue shape (protrusion shape), which is formed by a portion where a flow path wall 16B1 on the inner side in the radial direction in the scroll flow path 16B and a flow path wall 16A2 on the outer side in the radial direction in the scroll flow path 16A are connected to each other, at a position of an outlet E2 of the scroll flow path 16B.

Hereinafter, examples of shapes of the tongue portion 20A and the tongue portion 20B will be described with reference to FIGS. 2 to 6. Some embodiments described using FIGS. 2 to 6 may be applied to either one of the configuration of the H-H cross section and the configuration of the I-I cross section illustrated in FIG. 1 or may be applied to both of the configurations. In a case where the description of some embodiments illustrated in FIGS. 2 to 6 is interpreted as the description of the H-H cross section, the "scroll flow path 16" in the following description means the "scroll flow path 16A", and the "tongue portion 20" in the following description means the "tongue portion 20A". In addition, in a case where the description of some embodiments illustrated in FIGS. 2 to 6 is interpreted as the description of the I-I cross section, the "scroll flow path 16" in the following description means the "scroll flow path 16B", and the "tongue portion 20" in the following description means the "tongue portion 20B".

In the cross section illustrated in FIG. 2, the tongue portion 20 is formed from a wall surface 21*h* on the hub 10 side (compressor side) in the scroll flow path 16 to a wall surface 21*s* on the shroud 14 side in the scroll flow path 16, and includes an outer end edge 22, which is an edge of the tongue portion 20 on the outer side in the radial direction, and an inner end edge 24, which is an edge of the tongue portion 20 on the inner side in the radial direction. In the illustrated example, the outer end edge 22 is formed to be parallel to the axial direction. In addition, the inner end edge 24 faces a front edge 12LE of the blade 12 of the turbine wheel 6 with a clearance d in the radial direction interposed therebetween. In the cross section illustrated in FIG. 2, the front edge 12LE of the blade 12 of the turbine wheel 6 extends parallel to the axial direction along the axial direction.

In the cross section illustrated in FIG. 2, the inner end edge 24 includes at least one inclined portion 26 inclined with respect to the axial direction. In the exemplary embodiment illustrated in FIG. 2, the inner end edge 24 is formed only by one inclined portion 26 inclined with respect to the axial direction in a cross section along the axial direction, and the inclined portion 26 extends linearly to the outer side in the radial direction from the hub 10 side toward the shroud 14 side in the axial direction. In the cross section illustrated in FIG. 2, the inclined portion 26 is formed over the entire inner end edge 24 from the wall surface 21*h* on the hub 10 side in the scroll flow path 16 to the wall surface 21*s* on the shroud 14 side in the scroll flow path 16.

In the cross section illustrated in FIG. 2, in a case where a size of a range where the front edge 12LE is provided in the axial direction is denoted by A, and a size of a range where the inclined portion 26 is provided in the axial direction is denoted by B, the inner end edge 24 is formed to satisfy B≥0.2A. In addition, in the illustrated example, the inner end edge 24 is formed to satisfy B≥0.5 and B≥0.8.

In addition, in the cross section illustrated in FIG. 2, in a case where a minimum value of the clearance d between the inner end edge 24 and the front edge 12LE is denoted by dmin, a maximum value of the clearance d between the inner end edge 24 and the front edge 12LE is denoted by dmax, and a diameter of the turbine wheel 6 is denoted by D, the inner end edge 24 is formed to satisfy dmin/D≥0.02 and dmax/D≤0.09.

With the configuration illustrated in FIG. 2, since the inner end edge 24 of the tongue portion 20 includes the inclined portion 26 that is inclined with respect to the axial direction, the clearance d between the inner end edge 24 of the tongue portion 20 and the front edge 12LE of the blade 12 of the turbine wheel 6 is changed in accordance with the position in the axial direction, in a range where the inclined portion 26 is formed in the axial direction. Therefore, it is possible to reduce the strength of the vortex generated from the tongue portion 20, and it is possible to suppress the generation of noise caused by interference between the vortex generated from the tongue portion 20 and the front edge 12LE of the blade 12.

In addition, by satisfying B≥0.2A, in a half or more of a range A where the front edge 12LE of the blade 12 is provided in the axial direction, the clearance d between the inner end edge 24 of the tongue portion 20 and the front edge 12LE of the blade 12 is changed in accordance with the position in the axial direction. Therefore, it is possible to effectively reduce the strength of the vortex generated from the tongue portion 20, and it is possible to effectively suppress the generation of noise caused by interference between the vortex generated from the tongue portion 20 and the front edge 12LE of the blade 12. Accordingly, it is possible to provide the turbine housing 8 capable of realizing the turbine 4 having excellent quietness. In addition, since the inclined portion 26 is formed over the entire inner end edge 24, it is possible to suppress the generation of noise caused by interference between the vortex generated from the tongue portion 20 and the front edge 12LE of the blade 12 while suppressing the complexity of the shape of the tongue portion 20.

In addition, as the clearance between the inner end edge 24 of the tongue portion 20 and the front edge 12LE of the blade 12 becomes smaller, the performance of the turbine 4 tends to be better, but the noise tends to be increased. However, by satisfying dmin/D≥0.02 and dmax/D≤0.09 as described above, it is possible to suppress an increase in noise caused by interference between the vortex generated from the tongue portion 20 and the front edge 12LE of the blade 12 while achieving good performance of the turbine 4.

Figure 3:
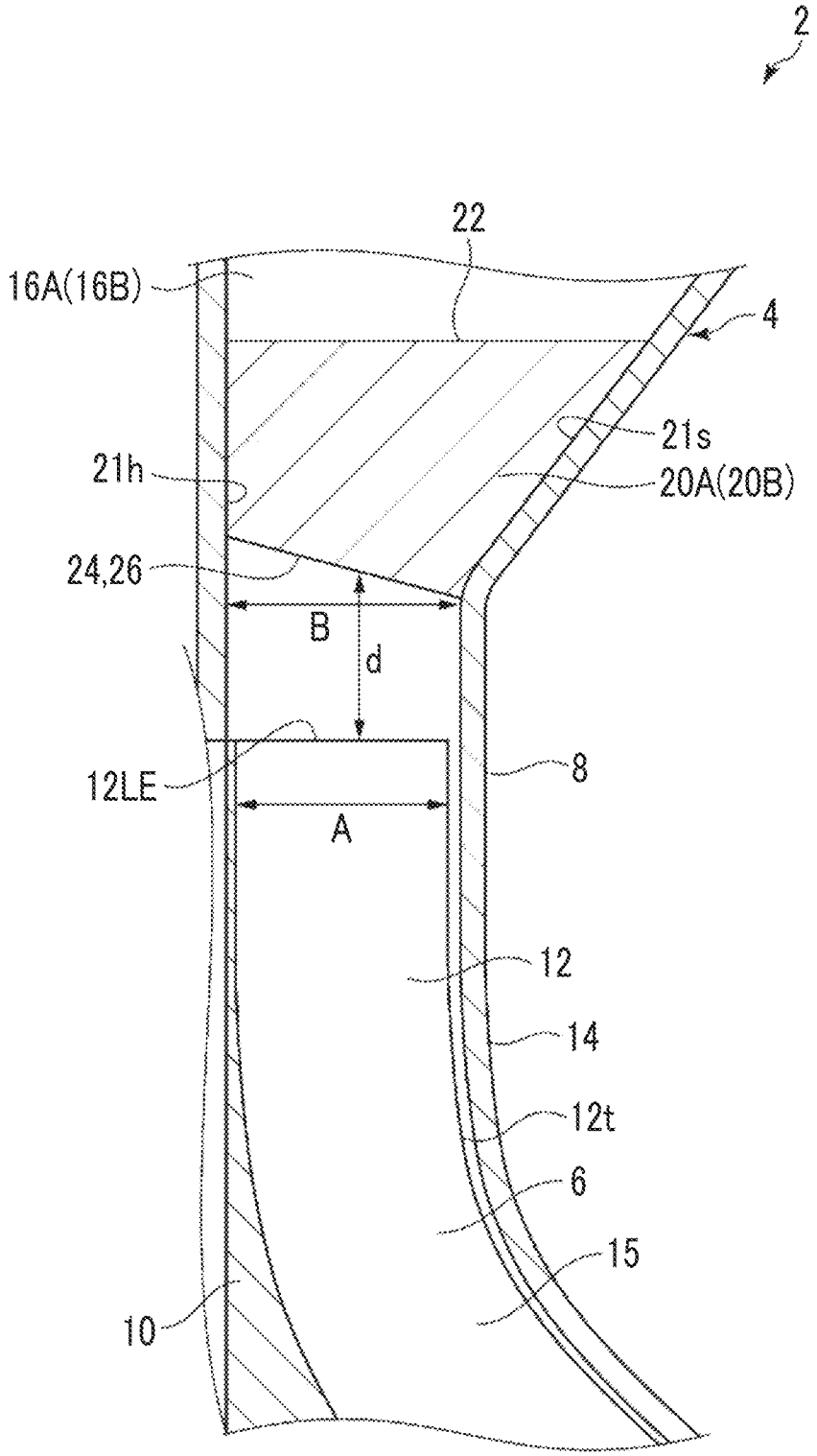
FIG. 3 is a schematic sectional view illustrating another example of the H-H cross section and another example of the I-I cross section of FIG. 1.

FIG. 3 is a schematic sectional view illustrating another example of the H-H cross section and another example of the I-I cross section of FIG. 1.

In the exemplary embodiment illustrated in FIG. 3, the inclined portion 26 of the inner end edge 24 of the tongue portion 20 is inclined with respect to the axial direction, and extends linearly to the inner side in the radial direction from the hub 10 side to ward the shroud 14 side in the axial direction, in the cross section along the axial direction. In the cross section illustrated in FIG. 3, the inclined portion 26 is formed over the entire inner end edge 24 from the wall surface 21*h* on the hub 10 side in the scroll flow path 16 to the wall surface 21*s* on the shroud 14 side in the scroll flow path 16. Also in the cross section illustrated in FIG. 3, the front edge 12LE of the blade 12 of the turbine wheel 6 extends parallel to the axial direction along the axial direction.

In the cross section illustrated in FIG. 3, in a case where a size of a range where the front edge 12LE is provided in the axial direction is denoted by A, and a size of a range where the inclined portion 26 is provided in the axial direction is denoted by B, the inner end edge 24 is formed to satisfy B≥0.2A. In addition, in the illustrated example, the inner end edge 24 is formed to satisfy B≥0.5 and B≥0.8. In addition, also in the cross section illustrated in FIG. 3, although not illustrated, in a case where a minimum value of the clearance between the inner end edge 24 and the front edge 12LE is denoted by dmin, a maximum value of the clearance between the inner end edge 24 and the front edge 12LE is denoted by dmax, and a diameter of the turbine wheel 6 is denoted by D, the inner end edge 24 is formed to satisfy dmin/D≥0.02 and dmax/D≤0.09.

Also in the configuration illustrated in FIG. 3, the clearance d between the inner end edge 24 of the tongue portion 20 and the front edge 12LE of the blade 12 of the turbine wheel 6 is changed in accordance with the position in the axial direction, in a range where the inclined portion 26 is formed in the axial direction. Therefore, it is possible to reduce the strength of the vortex generated from the tongue portion 20, and it is possible to suppress the generation of noise caused by interference between the vortex generated from the tongue portion 20 and the front edge 12LE of the blade 12. In addition, by satisfying B≥0.2A, it is possible to effectively reduce the strength of the vortex generated from the tongue portion 20, and it is possible to effectively suppress the generation of noise caused by interference between the vortex generated from the tongue portion 20 and the front edge 12LE of the blade 12. Accordingly, it is possible to provide the turbine housing capable of realizing the turbine having excellent quietness. In addition, by satisfying dmin/D≥0.02 and dmax/D≤0.09, it is possible to suppress an increase in noise caused by interference between the vortex generated from the tongue portion 20 and the front edge 12LE of the blade 12 while achieving good performance of the turbine 4. In addition, since the inclined portion 26 is formed over the entire inner end edge 24, it is possible to suppress the generation of noise caused by interference between the vortex generated from the tongue portion 20 and the front edge 12LE of the blade 12 while suppressing the complexity of the shape of the tongue portion 20.

Figure 4:
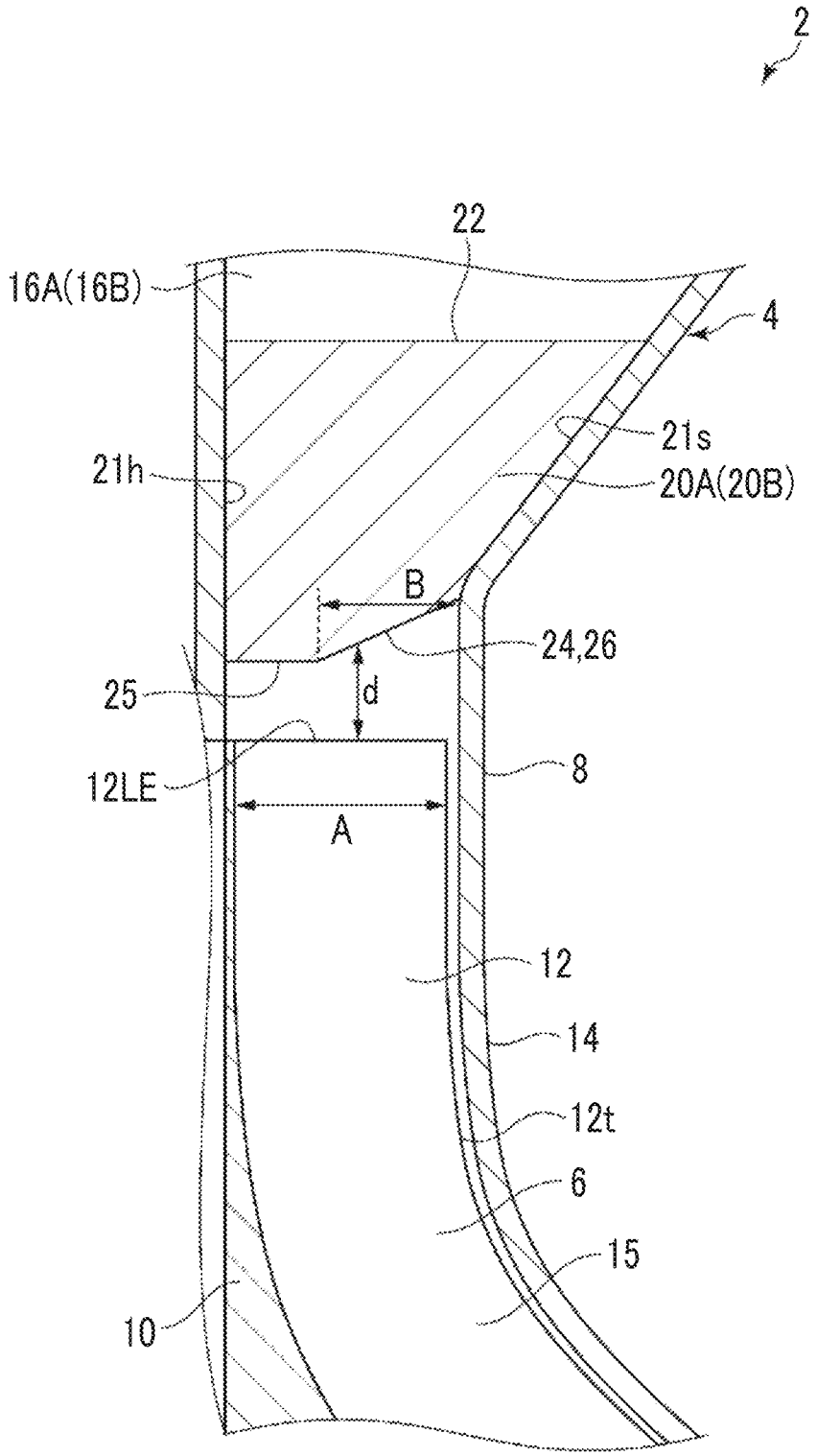
FIG. 4 is a schematic sectional view illustrating still another example of the H-H cross section and still another example of the I-I cross section of FIG. 1.

FIG. 4 is a schematic sectional view illustrating still another example of the H-H cross section and still another example of the I-I cross section of FIG. 1.

In the exemplary embodiment illustrated in FIG. 4, the inner end edge 24 of the tongue portion 20 includes a parallel portion 25 parallel to the axial direction and the inclined portion 26 inclined with respect to the axial direction, in the cross section along the axial direction. In the cross section illustrated in FIG. 4, one end of the parallel portion 25 is connected to the wall surface 21*h* on the hub 10 side in the scroll flow path 16, and the other end of the parallel portion 25 is connected to one end of the inclined portion 26. The other end of the inclined portion 26 is connected to the wall surface 21*s* on the shroud 14 side in the scroll flow path 16. In the cross section illustrated in FIG. 4, the inclined portion 26 extends linearly to the outer side in the radial direction from the hub 10 side toward the shroud 14 side in the axial direction. Also in the cross section illustrated in FIG. 4, the front edge 12LE of the blade 12 of the turbine wheel 6 extends parallel to the axial direction along the axial direction.

In the cross section illustrated in FIG. 4, in a case where a size of a range where the front edge 12LE is provided in the axial direction is denoted by A, and a size of a range where the inclined portion 26 is provided in the axial direction is denoted by B, the inner end edge 24 is formed to satisfy B≥0.2A. In addition, also in the cross section illustrated in FIG. 4, although not illustrated, in a case where a minimum value of the clearance between the inner end edge 24 and the front edge 12LE is denoted by dmin, a maximum value of the clearance between the inner end edge 24 and the front edge 12LE is denoted by dmax, and a diameter of the turbine wheel 6 is denoted by D, the inner end edge 24 is formed to satisfy dmin/D≥0.02 and dmax/D≤0.09.

With the configuration illustrated in FIG. 4, the clearance d between the inner end edge 24 of the tongue portion 20 and the front edge 12LE of the blade 12 of the turbine wheel 6 is changed in accordance with the position in the axial direction, in a range where the inclined portion 26 is formed in the axial direction. Therefore, it is possible to reduce the strength of the vortex generated from the tongue portion 20, and it is possible to suppress the generation of noise caused by interference between the vortex generated from the tongue portion 20 and the front edge 12LE of the blade 12. In addition, by satisfying B≥0.2A, it is possible to effectively reduce the strength of the vortex generated from the tongue portion 20, and it is possible to effectively suppress the generation of noise caused by interference between the vortex generated from the tongue portion 20 and the front edge 12LE of the blade 12. Accordingly, it is possible to provide the turbine housing capable of realizing the turbine having excellent quietness. In addition, by satisfying dmin/D≥0.02 and dmax/D≤0.09, it is possible to suppress an increase in noise caused by interference between the vortex generated from the tongue portion 20 and the front edge 12LE of the blade 12 while achieving good performance of the turbine 4.

Figure 5:
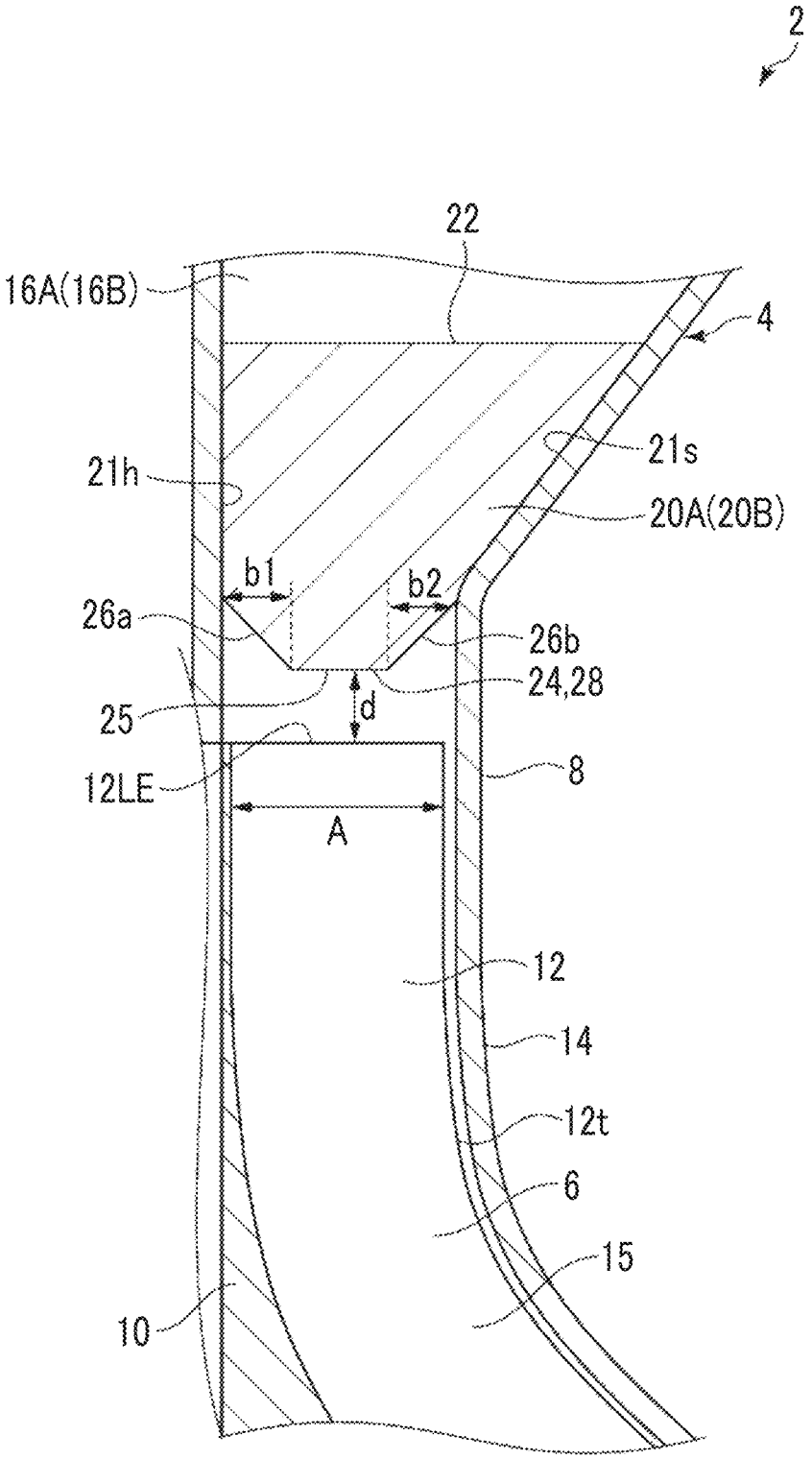
FIG. 5 is a schematic sectional view illustrating still another example of the H-H cross section and still another example of the I-I cross section of FIG. 1.

FIG. 5 is a schematic sectional view illustrating still another example of the H-H cross section and still another example of the I-I cross section of FIG. 1.

In the exemplary embodiment illustrated in FIG. 5, the inner end edge 24 of the tongue portion 20 has a convex shape 28 that protrudes inward in the radial direction, in the cross section along the axial direction. In the cross section illustrated in FIG. 5, the inner end edge 24 of the tongue portion 20 includes the parallel portion 25 parallel to the axial direction, an inclined portion 26*a* inclined with respect to the axial direction, and an inclined portion 26*b* inclined with respect to the axial direction. In the cross section illustrated in FIG. 5, one end of the inclined portion 26*a* is connected to the wall surface 21*h* on the hub 10 side in the scroll flow path 16, and the other end of the inclined portion 26*a* is connected to one end of the parallel portion 25. In addition, the other end of the parallel portion 25 is connected to one end of the inclined portion 26*b*, and the other end of the inclined portion 26*b* is connected to the wall surface 21*s* on the shroud 14 side in the scroll flow path 16. In the cross section illustrated in FIG. 5, the inclined portion 26*a* extends linearly to the inner side in the radial direction from the hub 10 side toward the shroud 14 side in the axial direction, and the inclined portion 26*b* extends linearly to the outer side in the radial direction from the hub 10 side toward the shroud 14 side in the axial direction. Also in the cross section illustrated in FIG. 5, the front edge 12LE of the blade 12 of the turbine wheel 6 extends parallel to the axial direction along the axial direction.

In the cross section illustrated in FIG. 5, in a case where a size of a range where the front edge 12LE is provided in the axial direction is denoted by A, a size of a range where the inclined portion 26*a* is provided in the axial direction is denoted by b1, a size of a range where the inclined portion 26*b* is provided in the axial direction is denoted by b2, and a total of the size b1 of the range where the inclined portion 26*a* is provided in the axial direction and the size b2 of the range where the inclined portion 26*b* is provided in the axial direction is denoted by B (=b1+b2), the inner end edge 24 is formed to satisfy B≥0.2A. In addition, also in the cross section illustrated in FIG. 5, although not illustrated, in a case where a minimum value of the clearance between the inner end edge 24 and the front edge 12LE is denoted by dmin, a maximum value of the clearance between the inner end edge 24 and the front edge 12LE is denoted by dmax, and a diameter of the turbine wheel 6 is denoted by D, the inner end edge 24 is form ed to satisfy dmin/D≥0.02 and dmax/D≤0.09.

In the configuration illustrated in FIG. 5, in the range where the inclined portion 26*a* is formed in the axial direction, the clearance d between the inner end edge 24 of the tongue portion 20 and the front edge 12LE of the blade 12 can be decreased from the hub 10 side toward the shroud 14 side in the axial direction. In addition, in the range where the inclined portion 26*b* is formed in the axial direction, the clearance d between the inner end edge 24 of the tongue portion 20 and the front edge 12LE of the blade 12 can be increased from the hub 10 side toward the shroud 14 side in the axial direction. In this way, by narrowing or widening the clearance d between the inner end edge 24 of the tongue portion 20 and the front edge 12LE of the blade 12 from the hub 10 side to the shroud 14 side in the axial direction, it is possible to effectively reduce the strength of the vortex generated from the tongue portion 20, and it is possible to effectively suppress the generation of noise caused by interference between the vortex generated from the tongue portion 20 and the front edge 12LE of the blade 12. In addition, by satisfying B≥0.2A, it is possible to effectively reduce the strength of the vortex generated from the tongue portion 20, and it is possible to effectively suppress the generation of noise caused by interference between the vortex generated from the tongue portion 20 and the front edge 12LE of the blade 12. In addition, by satisfying dmin/D≥0.02 and dmax/D≤0.09, it is possible to suppress an increase in noise caused by interference between the vortex generated from the tongue portion 20 and the front edge 12LE of the blade 12 while achieving good performance of the turbine 4.

Figure 6:
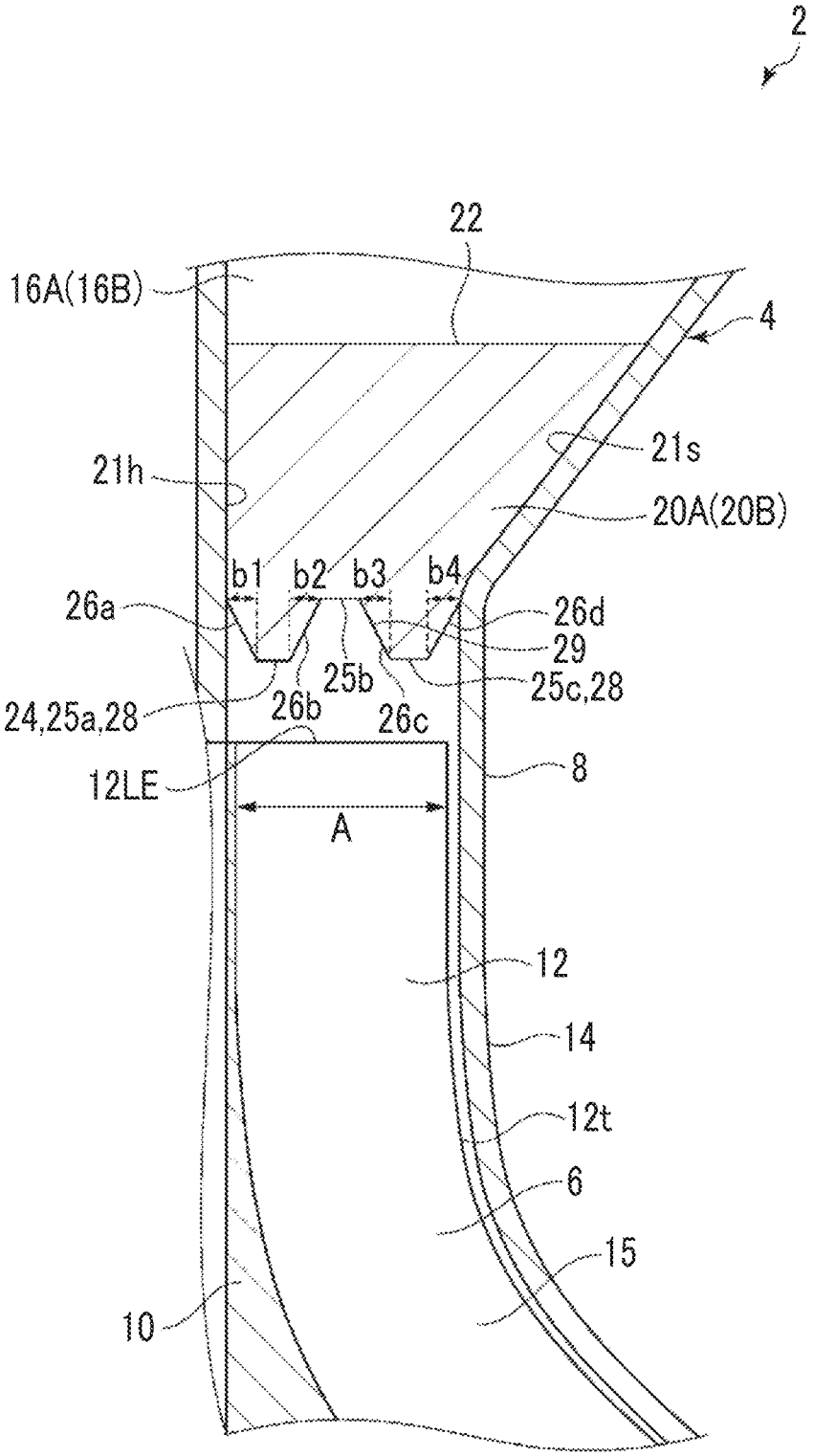
FIG. 6 is a schematic sectional view illustrating still another example of the H-H cross section and still another example of the I-I cross section of FIG. 1.

FIG. 6 is a schematic sectional view illustrating still another example of the H-H cross section and still another example of the I-I cross section of FIG. 1.

In the exemplary embodiment illustrated in FIG. 6, in the cross section along the axial direction, the inner end edge 24 of the tongue portion 20 includes two convex shapes 28 that protrude inward in the radial direction, the two convex shapes 28 are formed to be aligned with each other in the axial direction, and a concave shape 29 is formed between the two convex shapes 28 in the axial direction.

In the exemplary embodiment illustrated in FIG. 6, the inner end edge 24 of the tongue portion 20 includes parallel portions 25*a*, 25*b*, and 25*c* parallel to the axial direction, and inclined portions 26*a*, 26*b*, 26*c*, and 26*d* inclined with respect to the axial direction, in the cross section along the axial direction. In the cross section illustrated in FIG. 6, one end of the inclined portion 26*a* is connected to the wall surface 21*h* on the hub 10 side in the scroll flow path 16, and the other end of the inclined portion 26*a* is connected to one end of the parallel portion 25*a*. In addition, the other end of the parallel portion 25*a* is connected to one end of the inclined portion 26*b*, and the other end of the inclined portion 26*b* is connected to one end of the parallel portion 25*b*. In addition, the other end of the parallel portion 25*b* is connected to one end of the inclined portion 26*c*, and the other end of the inclined portion 26*c* is connected to one end of the parallel portion 25*c*. The other end of the parallel portion 25*c* is connected to one end of the inclined portion 26*d*, and the other end of the inclined portion 26*d* is connected to the wall surface 21*s* on the shroud 14 side in the scroll flow path 16.

In the cross section illustrated in FIG. 6, the inclined portion 26*a* extends linearly to the inner side in the radial direction from the hub 10 side toward the shroud 14 side in the axial direction, and the inclined portion 26*b* extends linearly to the outer side in the radial direction from the hub 10 side toward the shroud 14 side in the axial direction. In addition, the inclined portion 26*c* extends linearly to the inner side in the radial direction from the hub 10 side toward the shroud 14 side in the axial direction, and the inclined portion 26*d* extends linearly to the outer side in the radial direction from the hub 10 side toward the shroud 14 side in the axial direction. Also in the cross section illustrated in FIG. 6, the front edge 12LE of the blade 12 of the turbine wheel 6 extends parallel to the axial direction along the axial direction.

In the cross section illustrated in FIG. 6, in a case where a size of a range where the front edge 12LE is provided in the axial direction is denoted by A, a size of a range where the inclined portion 26*a* is provided in the axial direction is denoted by b1, a size of a range where the inclined portion 26*b* is provided in the axial direction is denoted by b2, a size of a range where the inclined portion 26*c* is provided in the axial direction is denoted by b3, a size of a range where the inclined portion 26*d* is provided in the axial direction is denoted by b4, and a total of the size b1 of the range where the inclined portion 26*a* is provided in the axial direction, the size b2 of the range where the inclined portion 26*b* is provided in the axial direction, the size b3 of the range where the inclined portion 26*c* is provided in the axial direction, and the size b4 of the range where the inclined portion 26*d* is provided in the axial direction is denoted by B(=b1+b2+b3+b4), the inner end edge 24 is formed to satisfy B≥0.2A. In addition, also in the cross section illustrated in FIG. 6, in a case where a minimum value of the clearance between the inner end edge 24 and the front edge 12LE is denoted by dmin, a maximum value of the clearance between the inner end edge 24 and the front edge 12LE is denoted by dmax, and a diameter of the turbine wheel 6 is denoted by D, the inner end edge 24 is formed to satisfy dmin/D≥0.02 and dmax/D≤0.09.

In the configuration illustrated in FIG. 6, the effect obtained by widening or narrowing the clearance d between the inner end edge 24 of the tongue portion 20 and the front edge 12LE of the blade 12 from the hub 10 side to the shroud 14 side in the axial direction (the effect of reducing the strength of the vortex generated from the tongue portion 20) can be further enhanced compared to the configuration illustrated in FIG. 5, and it is possible to effectively suppress the generation of noise caused by interference between the vortex generated from the tongue portion 20 and the front edge 12LE of the blade 12. In addition, by satisfying B≥0.2A, it is possible to effectively reduce the strength of the vortex generated from the tongue portion 20, and it is possible to effectively suppress the generation of noise caused by interference between the vortex generated from the tongue portion 20 and the front edge 12LE of the blade 12. In addition, by satisfying dmin/D≥0.02 and dmax/D≤0.09, it is possible to suppress an increase in noise caused by interference between the vortex generated from the tongue portion 20 and the front edge 12LE of the blade 12 while achieving good performance of the turbine 4.

Figure 7:
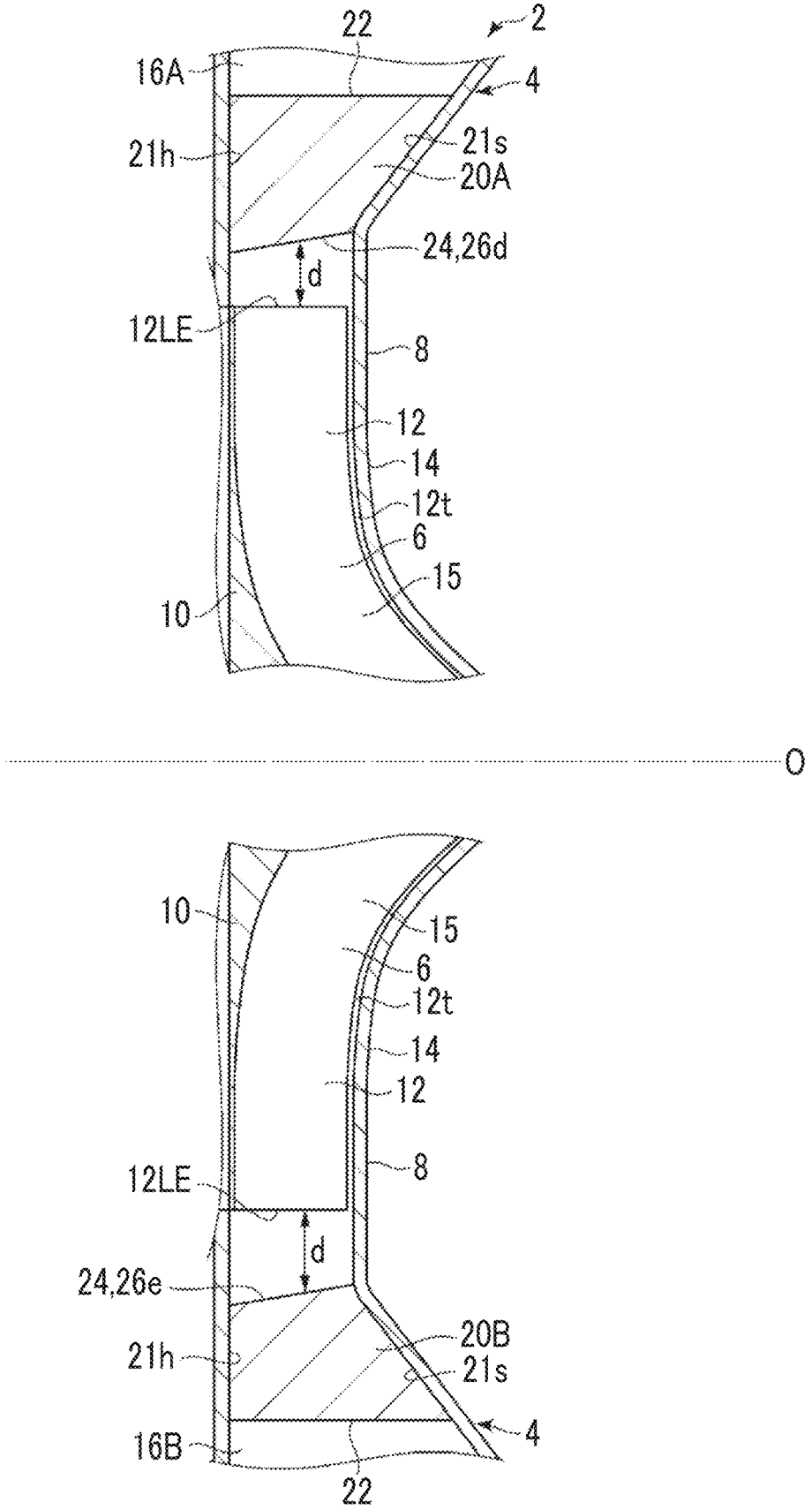
FIG. 7 is a schematic sectional view illustrating an example of a cross section a long the axial direction passing through each of a tongue portion 20A, a rotational axis line O, and a tongue portion 20B in the turbine 4 illustrated in FIG. 1.

FIG. 7 is a schematic sectional view illustrating an example of a cross section a long the axial direction passing through each of a tongue portion 20A, a rotational axis line O, and a tongue portion 20B in the turbine 4 illustrated in FIG. 1.

In the exemplary embodiment illustrated in FIG. 7, the tongue portion 20A has the same configuration as the configuration illustrated in FIG. 2, and the tongue portion 20B has the same configuration as the configuration illustrated in FIG. 3. In the turbine 4 illustrated in FIG. 7, in the cross section along the axial direction, the inner end edge 24 of the tongue portion 20A includes the inclined portion 26*d* that extends to the outer side in the radial direction from the hub 10 side toward the shroud 14 side in the axial direction, and the inner end edge 24 of the tongue portion 20B includes an inclined portion 26*e* that extends to the inner side in the radial direction from the hub 10 side toward the shroud 14 side in the axial direction. Also in the cross section illustrated in FIG. 7, the front edge 12LE of the blade 12 of the turbine wheel 6 extends parallel to the axial direction along the axial direction. In addition, a range where the inclined portion 6*d* is provided in the axial direction overlaps with at least a part of a range where the inclined portion 26*e* is provided in the axial direction (in the illustrated example, the entire range where the inclined portion 26*e* is provided in the axial direction).

In the turbine 4 illustrated in FIG. 7, by setting the inclination direction of the inclined portion 26*d* and the inclination direction of the inclined portion 26*e* to be opposite to each other, the strength, the direction, and the like of the vortex generated in the tongue portion 20A and the strength, the direction, and the like of the vortex generated in the tongue portion 20B can be made uneven at the same position in the axial direction, and it is possible to suppress the amplification of the noise caused by the vortex generated in the tongue portion 20A and the noise caused by the vortex generated in the tongue portion 20B. Accordingly, it is possible to provide the turbine housing 8 capable of realizing the turbine 4 having excellent quietness.

Figure 8:
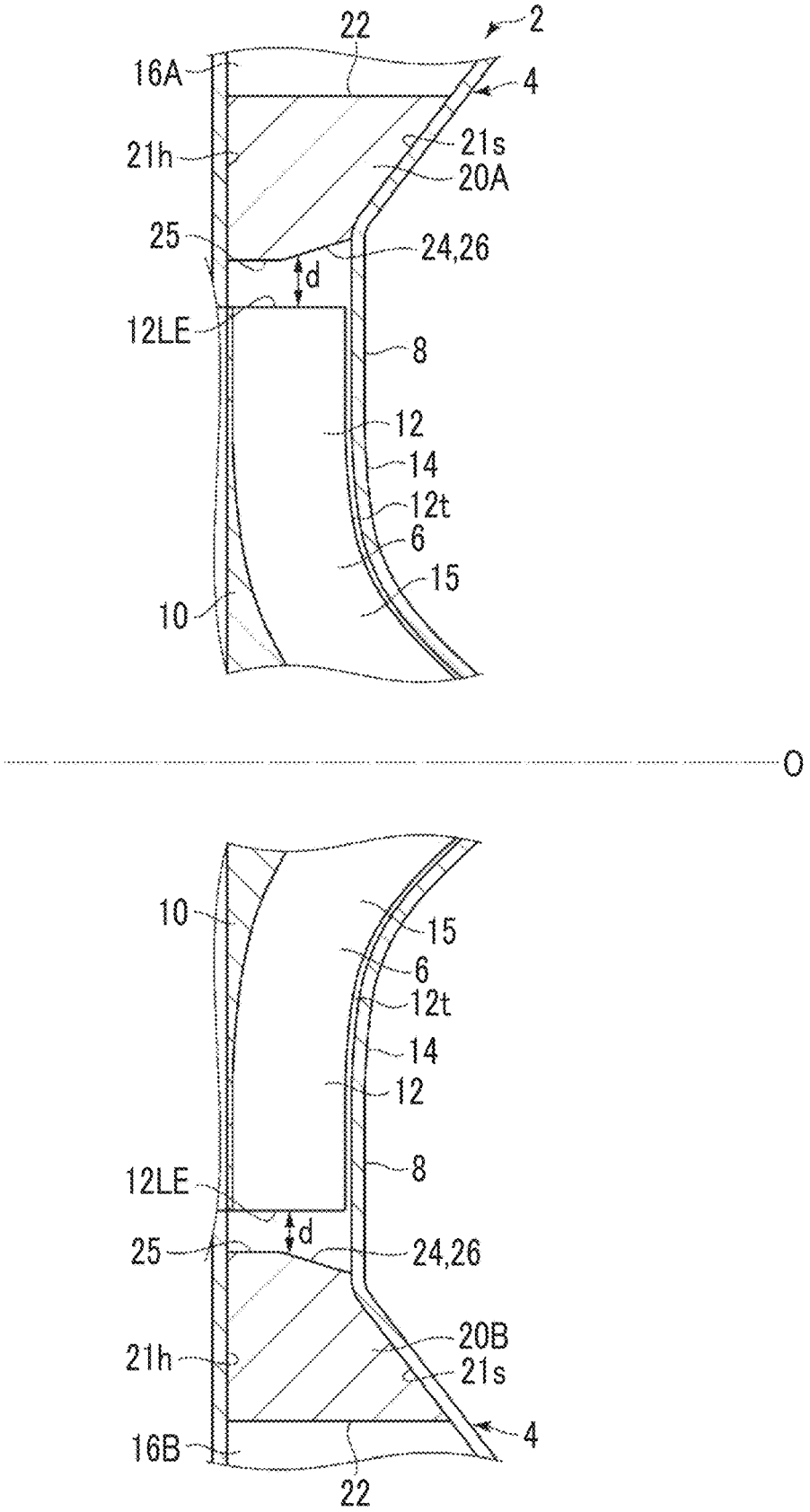
FIG. 8 is a schematic sectional view illustrating an example of a cross section a long the axial direction passing through each of a tongue portion 20A, a rotational axis line O, and a tongue portion 20B in the turbine 4 illustrated in FIG. 1.

FIG. 8 is a schematic sectional view illustrating an example of a cross section along the axial direction passing through each of a tongue portion 20A, a rotational axis line O, and a tongue portion 20B in the turbine 4 illustrated in FIG. 1.

In the exemplary embodiment illustrated in FIG. 8, each of the tongue portion 20A and the tongue portion 20B has the same configuration as the tongue portion 20 illustrated in FIG. 4. In the turbine 4 illustrated in FIG. 8, in the cross section along the axial direction, in a case where the clearance d between the inner end edge 24 of the tongue portion 20A and the front edge 12LE of the blade 12 and the clearance d between the inner end edge 24 of the tongue portion 20B and the front edge 12LE of the blade 1 2 are compared at the same position in the axial direction, the clearance d between the inner end edge 24 of the tongue portion 20A and the front edge 12LE of the blade 12 and the clearance d between the inner end edge 24 of the tongue portion 20B and the front edge 12LE of the blade 12 are different from each other in at least a part of a range (in the illustrated example, the entire range where the inner end edge 24 of the tongue portion 20A is formed in the axial direction) in the axial direction.

In the cross section illustrated in FIG. 8, each of the inner end edge 24 of the tongue portion 20A and the inner end edge 24 of the tongue portion 20B includes the parallel portion 25 parallel to the axial direction and the inclined portion 26 inclined with respect to the axial direction. Also in the cross section illustrated in FIG. 8, the front edge 12LE of the blade 12 of the turbine wheel 6 extends parallel to the axial direction along the axial direction. Here, the clearance d between the parallel portion 25 of the tongue portion 20A and the front edge 12LE of the blade 12 is larger than the clearance d between the parallel portion 25 of the tongue portion 20B and the front edge 12LE of the blade 12. In addition, in a case where the clearance d between the inclined port ion 26 of the tongue portion 20A and the front edge 12LE of the blade 12 is compared with the clearance d between the inclined portion 26 of the tongue portion 20B and the front edge 12LE of the blade 12 at the same position in the axial direction, in the entire range where the inclined portion 26 of the tongue portion 20A is formed in the axial direction, the clearance d between the inclined portion 26 of the tongue portion 20A and the front edge 12LE of the blade 12 is larger than the clearance d between the incline d portion 26 of the tongue portion 20B and the front edge 12LE of the blade 12.

In the turbine 4 illustrated in FIG. 8, by making the clearance d between the inner end edge 24 of the tongue portion 20A and the front edge 12LE of the blade 12 and the clearance d between the inner end edge 24 of the tongue portion 20B and the front edge 12LE of the blade 12 different from each other in at least a part of the range in the axial direction, the strength, the direction, and the like of the vortex generated in the tongue portion 20A and the strength, the direction, and the like of the vortex generated in the tongue portion 20B can be made uneven at the same position in the axial direction, and it is possible to suppress the amplification of the noise caused by the vortex generated in the tongue portion 20A and the noise caused by the vortex generated in the tongue portion 20B. Accordingly, it is possible to provide the turbine housing 8 capable of realizing the turbine 4 having excellent quietness.

Figure 9:
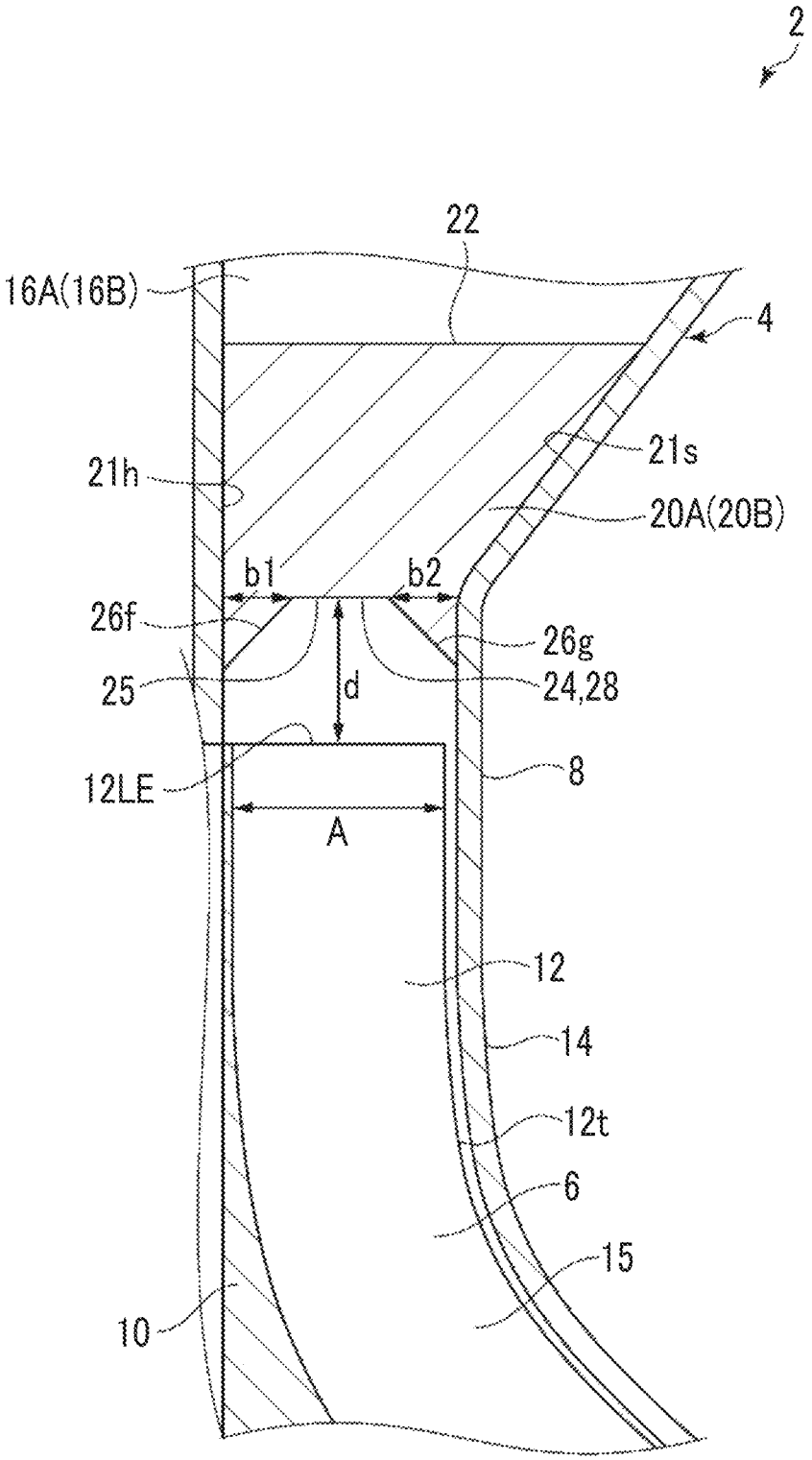
FIG. 9 is a schematic sectional view illustrating still another example of the H-H cross section and still another example of the I-I cross section of FIG. 1.

FIG. 9 is a schematic sectional view illustrating still another example of the H-H cross section and still another example of the I-I cross section of FIG. 1.

In the exemplary embodiment illustrated in FIG. 9, the inner end edge 24 of the tongue portion 20 has the concave shape 29 that is concave to the outer side in the radial direction, in the cross section along the axial direction. In the cross section illustrated in FIG. 9, the inner end edge 24 of the tongue portion 20 includes the parallel portion 25 parallel to the axial direction, an inclined portion 26*f* inclined with respect to the axial direction, and an inclined portion 26*g* inclined with respect to the axial direction. In the cross section illustrated in FIG. 9, one end of the inclined portion 26*f* is connected to the wall surface 21*h* on the hub 10 side in the scroll flow path 16, and the other end of the inclined portion 26*f* is connected to one end of the parallel portion 25. In addition, the other end of the parallel portion 25 is connected to one end of the inclined portion 26*g*, and the other end of the inclined portion 26*g* is connected to the wall surface 21*s* on the shroud 14 side in the scroll flow path 16. In the cross section illustrated in FIG. 9, the inclined portion 26*f* extends linearly to the outer side in the radial direction from the hub 10 side toward the shroud 14 side in the axial direction, and the inclined portion 26*g* extends linearly to the inner side in the radial direction from the hub 10 side toward the shroud 14 side in the axial direction. Also in the cross section illustrated in FIG. 9, the front edge 12LE of the blade 12 of the turbine wheel 6 extends parallel to the axial direction along the axial direction.

In the cross section illustrated in FIG. 9, in a case where a size of a range where the front edge 12LE is provided in the axial direction is denoted by A, a size of a range where the inclined portion 26*f* is provided in the axial direction is denoted by b1, a size of a range where the inclined portion 26*g* is provided in the axial direction is denoted by b2, and a total of the size b1 of the range where the inclined portion 26*f* is provided in the axial direction and the size b2 of the range where the inclined portion 26*g* is provided in the axial direction is denoted by B (=b1+b2), the inner end edge 24 is formed to satisfy B≥0.2A. In addition, also in the cross section illustrated in FIG. 9, although not illustrated, in a case where a minimum value of the clearance between the inner end edge 24 and the front edge 12LE is denoted by dmin, a maximum value of the clearance between the inner end edge 24 and the front edge 12LE is denoted by dmax, and a diameter of the turbine wheel 6 is denoted by D, the inner end edge 24 is form ed to satisfy dmin/D≥0.02 and dmax/D≤0.09.

In the configuration illustrated in FIG. 9, in the range where the inclined portion 26*f* is formed in the axial direction, the clearance d between the inner end edge 24 of the tongue portion 20 and the front edge 12LE of the blade 12 can be increased from the hub 10 side toward the shroud 14 side in the axial direction. In addition, in the range where the inclined portion 26*g* is formed in the axial direction, the clearance d between the inner end edge 24 of the tongue portion 20 and the front edge 12LE of the blade 12 can be decreased from the hub 10 side toward the shroud 14 side in the axial direction. In this way, by widening or narrowing the clearance d between the inner end edge 24 of the tongue portion 20 and the front edge 12LE of the blade 12 from the hub 10 side to the shroud 14 side in the axial direction, it is possible to effectively reduce the strength of the vortex generated from the tongue portion 20, and it is possible to effectively suppress the generation of noise caused by interference between the vortex generated from the tongue portion 20 and the front edge 12LE of the blade 12. In addition, by satisfying B≥0.2A, it is possible to effectively reduce the strength of the vortex generated from the tongue portion 20, and it is possible to effectively suppress the generation of noise caused by interference between the vortex generated from the tongue portion 20 and the front edge 12LE of the blade 12. In addition, by satisfying dmin/D≥0.02 and dmax/D≤0.09, it is possible to suppress an increase in noise caused by interference between the vortex generated from the tongue portion 20 and the front edge 1 2LE of the blade 12 while achieving good performance of the turbine 4.

The present disclosure is not limited to the embodiments described above, and also includes a form in which modifications are added to the embodiments described above or a form in which the embodiments are combined with each other as appropriate.

For example, in some embodiments described above, the configuration in which the turbine 4 includes the two scroll flow paths 16A and 16B is exemplified, but the number of scroll flow paths 16 provided in the turbine 4 may be one or three or more.

For example, contents described in each embodiment described above are understood as follows.

(1) A turbine housing (for example, the above-described turbine housing 8) according to at least an embodiment of the present disclosure is a turbine housing that houses at least a part of a turbine wheel (for example, the above-described turbine wheel 6), the turbine housing including:

a first scroll flow path (for example, the above-described scroll flow path 16 (16A or 16B)) for supplying a working gas to the turbine wheel; and a first tongue portion (for example, the above-described tongue portion 20 (20A or 20B)) formed at a position of an outlet (for example, the above-described outlet E1 or E2) of the first scroll flow path, in which, in a cross section along an axial direction of the turbine wheel, the first tongue portion includes an inner end edge (for example, the above-described inner end edge 24) that faces a front edge (for example, the above-described front edge 12LE) of a blade (for example, the above-described blade 12) of the turbine wheel with a clearance (for example, the above-described clearance d) in a radial direction of the turbine wheel interposed between the inner end edge and the front edge, the inner end edge includes at least one inclined portion (for example, the above-described inclined portions 26, 26*a*, 26*b*, 26*c*, 26*d*, and 26*e*) inclined with respect to the axial direction, and in a case where a size of a range where the front edge is provided in the axial direction is denoted by A, and a total of sizes of a range where each of the at least one inclined portion is provided in the axial direction is denoted by B, the inner end edge is configured to satisfy B≥0.2A.

With the turbine housing according to (1), since the inner end edge of the first tongue portion includes at least one inclined portion inclined with respect to the axial direction, the clearance between the inner end edge of the first tongue portion and the front edge of the blade of the turbine wheel is changed in accordance with the position in the axial direction, in a range where the at least one inclined portion is formed. Therefore, it is possible to reduce the strength of the vortex generated from the first tongue portion, and it is possible to suppress the generation of noise caused by interference between the vortex generated from the first tongue portion and the front edge of the blade of the turbine wheel.

In addition, by satisfying B≥0.2A, in a half or more of a range where the front edge of the blade of the turbine wheel is provided in the axial direction, the clearance between the inner end edge of the first tongue portion and the front edge of the blade of the turbine wheel is changed in accordance with the position in the axial direction. Therefore, it is possible to effectively reduce the strength of the vortex generated from the first tongue portion, and it is possible to effectively suppress the generation of noise caused by interference between the vortex generated from the tongue portion and the front edge of the blade of the turbine wheel. Accordingly, it is possible to provide the turbine housing capable of realizing the turbine having excellent quietness.

(2) In some embodiments, in the turbine housing according to (1), the inner end edge includes a first inclined portion (for example, the inclined portion 26 illustrated in FIGS. 2 and 4, the inclined portion 26*b* illustrated in FIG. 5, the inclined portions 26*b* and 26*d* illustrated in FIG. 6, the inclined portion 26*d* illustrated in FIG. 7, and the inclined portion 26 illustrated in FIG. 8) that is inclined to an outer side in the radial direction from a hub side of the turbine wheel to a shroud side in the axial direction.

With the turbine housing according to (2), in the range where the first inclined portion is formed in the axial direction, the clearance between the inner end edge of the first tongue portion and the front edge of the blade of the turbine wheel can be increased from the hub side to the shroud side in the axial direction. Therefore, it is possible to reduce the strength of the vortex generated from the first tongue portion, and it is possible to suppress the generation of noise caused by interference between the vortex generated from the first tongue portion and the front edge of the blade of the turbine wheel. Therefore, it is possible to provide the turbine housing capable of realizing the turbine having excellent quietness.

(3) In some embodiments, in the turbine housing according to (1), the inner end edge includes a first inclined portion (for example, the inclined portion 26 illustrated in FIG. 3, the inclined portion 26*a* illustrated in FIG. 5, the inclined portions 26*a* and 26*c* illustrated in FIG. 6, and the inclined portion 26*e* illustrated in FIG. 7) that is inclined to an inner side in the radial direction from a hub side of the turbine wheel to a shroud side in the axial direction.

With the turbine housing according to (3), in the range where the first inclined portion is formed in the axial direction, the clearance between the inner end edge of the first tongue portion and the front edge of the blade of the turbine wheel can be decreased from the hub side to the shroud side in the axial direction. Therefore, it is possible to reduce the strength of the vortex generated from the first tongue portion, and it is possible to suppress the generation of noise caused by interference between the vortex generated from the first tongue portion and the front edge of the blade of the turbine wheel. Therefore, it is possible to provide the turbine housing capable of realizing the turbine having excellent quietness.

(4) In some embodiments, in the turbine housing according to (2) or (3), the first inclined portion is formed over the entire inner end edge.

With the turbine housing according to (4), it is possible to suppress the generation of noise caused by interference between the vortex generated from the first tongue portion and the front edge of the blade of the turbine wheel while suppressing the complication of the shape of the first tongue portion.

(5) In some embodiments, in the turbine housing according to (2) or (3), the inner end edge includes a parallel portion (for example, the above-described parallel portions 25, 25*a*, 25*b*, and 25*c*) parallel to the axial direction.

With the turbine housing according to (5), it is possible to suppress the generation of noise caused by interference between the vortex generated from the first tongue portion and the front edge of the blade of the turbine wheel while suppressing the complication of the shape of the first tongue portion.

(6) In some embodiments, in the turbine housing according to (1), the inner end edge includes a first inclined portion (for example, the inclined portion 26*b* illustrated in FIG. 5, the inclined portions 26*b* and 26*d* illustrated in FIG. 6) that is inclined to an outer side in the radial direction from a hub side of the turbine wheel to a shroud side in the axial direction, and a second inclined portion (for example, the inclined portion 26*a* illustrated in FIG. 5, the inclined portions 26*a* and 26*c* illustrated in FIG. 6) that is inclined to an inner side in the radial direction from the hub side of the turbine wheel to the shroud side in the axial direction.

With the turbine housing according to (6), in the range where the first inclined portion is formed in the axial direction, the clearance between the inner end edge of the first tongue portion and the front edge of the blade of the turbine wheel can be increased from the hub side to the shroud side in the axial direction. In addition, in the range where the second inclined portion is formed in the axial direction, the clearance between the inner end edge of the first tongue portion and the front edge of the blade of the turbine wheel can be decreased from the hub side to the shroud side in the axial direction. In this way, by widening or narrowing the clearance between the inner end edge of the first tongue portion and the front edge of the blade of the turbine wheel from the hub side to the shroud side in the axial direction, it is possible to effectively reduce the strength of the vortex generated from the first tongue portion, and it is possible to effectively suppress the generation of noise caused by interference between the vortex generated from the first tongue portion and the front edge of the blade of the turbine wheel.

(7) In some embodiments, in the turbine housing according to any one of (1) to (6), in a case where a minimum value of the clearance between the inner end edge and the front edge is denoted by dmin, a maximum value of the clearance between the inner end edge and the front edge is denoted by dmax, and a diameter of the turbine wheel is denoted by D, $dmin/D \geq 0.02$ and $dmax/D \leq 0.09$ are satisfied.

As the clearance between the inner end edge of the first tongue portion and the front edge of the blade of the turbine wheel is reduced, the performance of the turbine is improved, but the noise tends to be increased. In this regard, with the turbine housing according to (7), by satisfying $dmin/D \geq 0.02$ and $dmax/D \leq 0.09$, it is possible to suppress an increase in noise caused by interference between the vortex generated from the first tongue portion and the front edge of the blade of the turbine wheel while achieving good performance of the turbine.

(8) In some embodiments, the turbine housing according to any one of (1) to (7), further includes:

a second scroll flow path (for example, the above-described scroll flow path 16 (16A or 16B)) for supplying a working gas to the turbine wheel; and a second tongue portion (for example, the above-described tongue portion 20 (20A or 20B)) formed at a position of an outlet (for example, the above-described outlet E1 or E2) of the second scroll flow path.

With the turbine housing according to (8), it is possible to effectively suppress the noise which is likely to be a problem in the turbine including two or more scroll flow paths, by providing at least one inclined portion on the inner end edge of the first tongue portion.

(9) In some embodiments, in the turbine housing according to (8), in a cross section along the axial direction, the second tongue portion includes an inner end edge (for example, the above-described inner end edge 24) that faces a front edge of a blade of the turbine wheel with a clearance in the radial direction interposed between the inner end edge and the front edge, and the inner end edge of the second tongue portion includes at least one inclined portion inclined with respect to the axial direction.

With the turbine housing according to (9), since the inner end edge of the second tongue portion includes at least one inclined portion inclined with respect to the axial direction, the clearance between the inner end edge of the second tongue portion and the front edge of the blade of the turbine wheel is changed in accordance with the position in the axial direction, in a range where the at least one inclined portion is formed.

Therefore, it is possible to reduce the strength of the vortex generated from the second tongue portion, and it is possible to suppress the generation of noise caused by interference between the vortex generated from the second tongue portion and the front edge of the blade of the turbine wheel. Therefore, it is possible to effectively suppress the noise which is likely to be a problem in the turbine including two or more scroll flow paths.

(10) In some embodiments, in the turbine housing according to (9), the inner end edge of the first tongue portion includes a first inclined portion that extends to an outer side in the radial direction from a hub side to a shroud side in the axial direction, the inner end edge of the second tongue portion includes a second inclined portion (for example, the above-described inclined portions 26, 26*a*, 26*b*, 26*c*, 26*d*, and 26*e*) that extends to an inner side in the radial direction from the hub side to the shroud side in the axial direction, and a range where the first inclined portion is provided in the axial direction overlaps with at least a part of a range where the second inclined portion is provided in the axial direction.

With the turbine housing according to (10), by setting the inclination direction of the first inclined portion and the inclination direction of the second inclined portion to be opposite to each other in at least a part of a range in the axial direction, the strength, the direction, and the like of the vortex generated in the first tongue portion and the strength, the direction, and the like of the vortex generated in the second tongue portion can be made uneven at the same position in the axial direction, and it is possible to suppress the amplification of the noise caused by the vortex generated in the first tongue portion and the noise caused by the vortex generated in the second tongue portion. Accordingly, it is possible to provide the turbine housing capable of realizing the turbine having excellent quietness.

(11) In some embodiments, in the turbine housing according to (9) or (10), in a case where the clearance between the inner end edge of the first tongue portion and the front edge of the blade of the turbine wheel is compared with the clearance between the inner end edge of the second tongue portion and the front edge of the blade of the turbine wheel at the same position in the axial direction, the clearance (for example, the clearance d between the inner end edge 24 of the tongue portion 20A and the front edge 12LE of the blade 12 illustrated in FIG. 8) between the inner end edge of the first tongue portion and the front edge of the blade of the turbine wheel and the clearance (for example, the clearance d between the inner end edge 24 of the tongue portion 20B and the front edge 12LE of the blade 12 illustrated in FIG. 8) between the inner end edge of the second tongue portion and the front edge of the blade of the turbine wheel are different from each other in at least a part of a range in the axial direction.

With the turbine housing according to (11), by making the clearance between the inner end edge of the first tongue portion and the front edge of the blade of the turbine wheel and the clearance between the inner end edge of the second tongue portion and the front edge of the blade of the turbine wheel different from each other in at least a part of the range in the axial direction, the strength, the direction, and the like of the vortex generated in the first tongue portion and the strength, the direction, and the like of the vortex generated in the second tongue portion can be made uneven at the same position in the axial direction, and it is possible to suppress the amplification of the noise caused by the vortex generated in the first tongue portion and the noise caused by the vortex generated in the second tongue portion. Accordingly, it is possible to provide the turbine housing capable of realizing the turbine having excellent quietness.

(12) A turbine according to at least one embodiment of the present disclosure includes a turbine wheel (for example, the above-described turbine wheel 6); and the turbine housing according to (1).

With the turbine according to (12), since the turbine housing according to (1) is provided, it is possible to effectively suppress the generation of noise caused by interference between the vortex generated from the tongue portion and the front edge of the blade of the turbine wheel. Accordingly, it is possible to provide the turbine housing capable of realizing the turbine having excellent quietness.

(13) A turbocharger according to at least one embodiment of the present disclosure includes the turbine according to (12).

With the turbocharger according to (13), since the turbine according to (12) is provided, it is possible to effectively suppress the generation of noise caused by interference between the vortex generated from the tongue portion and the front edge of the blade of the turbine wheel. Accordingly, it is possible to provide the turbocharger capable of realizing the turbine having excellent quietness.

REFERENCE SIGNS LIST

2: turbocharger
4: turbine
6: turbine wheel
8: turbine housing
10: hub
12: blade
12LE: front edge
12*t*: leading edge
14: shroud
15: exhaust gas passage
16, 16A, 16B: scroll flow path
16A1, 16A2, 16B1, 16B2: flow path wall
20, 20A, 20B: tongue portion
21*h*, 21*s*: wall surface
22: outer end edge
24: inner end edge
25, 25*a*, 25*b*, 25*c*: parallel portion
26, 26*a*, 26*b*, 26*c*, 26*d*, 26*e*: inclined portion
28: convex shape
29: concave shape

The invention claimed is:

1. A turbine housing that houses at least a part of a turbine wheel, the turbine housing comprising:

a first scroll flow path for supplying a working gas to the turbine wheel; and a first tongue portion formed at a position of an outlet of the first scroll flow path, wherein, in a cross section along an axial direction of the turbine wheel, the first tongue portion includes an inner end edge that faces a front edge of a blade of the turbine wheel with a clearance in a radial direction of the turbine wheel interposed between the inner end edge and the front edge, the inner end edge includes at least one inclined portion inclined with respect to the axial direction, and wherein an axial length of the front edge provided in the axial direction is denoted by A, and a total axial length of the at least one inclined portion provided in the axial direction is denoted by B, the inner end edge is configured to satisfy $B \geq 0.2A$.

2. The turbine housing according to claim 1, wherein the inner end edge includes a first inclined portion that is inclined to an outer side in the radial direction from a hub side of the turbine wheel to a shroud side in the axial direction.

3. The turbine housing according to claim 1, wherein the inner end edge includes a first inclined portion that is inclined to an inner side in the radial direction from a hub side of the turbine wheel to a shroud side in the axial direction.

4. The turbine housing according to claim 2, wherein the first inclined portion is formed over the entire inner end edge.

5. The turbine housing according to claim 2, wherein the inner end edge includes a parallel portion parallel to the axial direction.

6. The turbine housing according to claim 1, wherein the inner end edge includes a first inclined portion that is inclined to an outer side in the radial direction from a hub side of the turbine wheel to a shroud side in the axial direction, and a second inclined portion that is inclined to an inner side in the radial direction from the hub side of the turbine wheel to the shroud side in the axial direction.

7. The turbine housing according to claim 1, wherein a minimum value of the clearance between the inner end edge and the front edge is denoted by dmin, a maximum value of the clearance between the inner end edge and the front edge is denoted by dmax, and a diameter of the turbine wheel is denoted by D, and $dmin/D \geq 0.02$ and $dmax/D \leq 0.09$ are satisfied.

8. The turbine housing according to claim 1, further comprising:

a second scroll flow path for supplying the working gas to the turbine wheel; and a second tongue portion formed at a position of an outlet of the second scroll flow path.

9. The turbine housing according to claim 8, wherein, in the cross section along the axial direction, the second tongue portion includes an inner end edge that faces a front edge of a blade of the turbine wheel with a clearance in the radial direction interposed between the inner end edge and the front edge, and in the cross section along the axial direction, the inner end edge of the second tongue portion includes at least one inclined portion inclined with respect to the axial direction.

10. The turbine housing according to claim 9, wherein the inner end edge of the first tongue portion includes a first inclined portion that extends to an outer side in the radial direction from a hub side to a shroud side in the axial direction, the inner end edge of the second tongue portion includes a second inclined portion that extends to an inner side in the radial direction from the hub side to the shroud side in the axial direction, and an axial section where the first inclined portion is provided in the axial direction overlaps with at least a part of an axial section where the second inclined portion is provided in the axial direction.

11. The turbine housing according to claim 9, wherein the clearance between the inner end edge of the first tongue portion and the front edge of the blade of the turbine wheel is compared with the clearance between the inner end edge of the second tongue portion and the front edge of the blade of the turbine wheel at a same position in the axial direction, the clearance between the inner end edge of the first tongue portion and the front edge of the blade of the turbine wheel and the clearance between the inner end edge of the second tongue portion and the front edge of the blade of the turbine wheel are different from each other in at least a part of an axial section in the axial direction.

12. A turbine comprising:

a turbine wheel; and the turbine housing according to claim 1.

13. A turbocharger comprising the turbine according to claim 12.

* * * * *